US007104256B2

(12) United States Patent
Shin

(10) Patent No.: US 7,104,256 B2
(45) Date of Patent: Sep. 12, 2006

(54) THROTTLE BODY FIXING STRUCTURE

(75) Inventor: Chang Hyun Shin, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/010,007

(22) Filed: Dec. 10, 2004

(65) Prior Publication Data

US 2005/0217641 A1 Oct. 6, 2005

(30) Foreign Application Priority Data

Mar. 31, 2004 (KR) ..... 10-2004-0022015

(51) Int. Cl.
*F02M 1/00* (2006.01)

(52) U.S. Cl. ..... 123/470; 123/184.25

(58) Field of Classification Search ..... 123/399, 123/472, 470, 184.25, 184.34, 182.42, 184.47
See application file for complete search history.

(56) References Cited

U.S. PATENT DOCUMENTS 5,012,770 A * 5/1991 Okamoto et al. ..... 123/184.42
2005/0173918 A1* 8/2005 Eguchi et al. ..... 280/834
2005/0217947 A1* 10/2005 Honda et al. ..... 188/1.11 W

FOREIGN PATENT DOCUMENTS

JP 11-013563 1/1999

* cited by examiner

*Primary Examiner*—John T. Kwon
(74) *Attorney, Agent, or Firm*—Morgan Lewis & Bockius LLP

(57) ABSTRACT

A throttle body fixing structure adapted to firmly fix a throttle body to the engine under a simple structure, wherein the throttle body connects to a surge tank made of a plastic material. The vehicle weight is reduced, and maintenance and assembly are simplified. Furthermore, noise and vibration are minimized and the durability is increased.

11 Claims, 6 Drawing Sheets

(a)

(b)

THROTTLE BODY FIXING STRUCTURE

CROSS-REFERENCE TO RELATED APPLICATIONS

The present application is based on, and claims priority from, Korean Application Serial Number 10-2004-0022015, filed on Mar. 31, 2004, the disclosure of which is hereby incorporated by reference herein in its entirety.

FIELD OF THE INVENTION

The present invention relates to a throttle body fixing structure of an engine equipped with a plastic surge tank.

BACKGROUND OF THE INVENTION

Generally, a surge tank is made of a metallic material such as aluminum or the like. One end of the surge tank integrally couples to a throttle body.

The surge tank is fixed to the engine via a protrusive flange and a stay. The protrusive flange is formed at one end of the surge tank, and the stay connects the protrusive flange and the engine therebetween.

In case a plastic surge tank is applied for reducing the engine weight, the throttle body directly coupled and supported by the surge tank is made primarily of a metal, e.g., aluminum. As a result, when the plastic surge tank and metallic throttle body are coupled to each other, the balance of the weight is concentrated on the heavy throttle body.

Furthermore, the firm supporting force conventionally provided from the metallic surge tank to the throttle body cannot be expected from the surge tank made of a plastic material.

SUMMARY OF THE INVENTION

Embodiments of the present invention fix a throttle body to the engine with a simple structure wherein the throttle body couples to a plastic surge tank, thereby reducing the vehicle weight, and simplifying maintenance and assembly in comparison to the conventional structures. Furthermore, noise and vibration are minimized and the durability is increased.

In one embodiment of the invention, a throttle body fixing structure comprises a throttle body coupled with a plastic surge tank. A cylinder head is equipped at the top surface thereof with a cylinder head cover. A fixing bracket connects a fixing tap of the throttle body and a fixing tap of the cylinder head, wherein the fixing tap of the throttle body is vertically formed at an upper side of the fixing tap of the cylinder head within the range of ±10° from a vertical direction.

BRIEF DESCRIPTION OF THE DRAWINGS

For a better understanding of the nature and objects of the present invention, reference should be made to the following detailed description of an exemplary embodiment together with the accompanying drawings, in which.

DETAILED DESCRIPTION OF A PREFERRED EMBODIMENT

Figure 1:
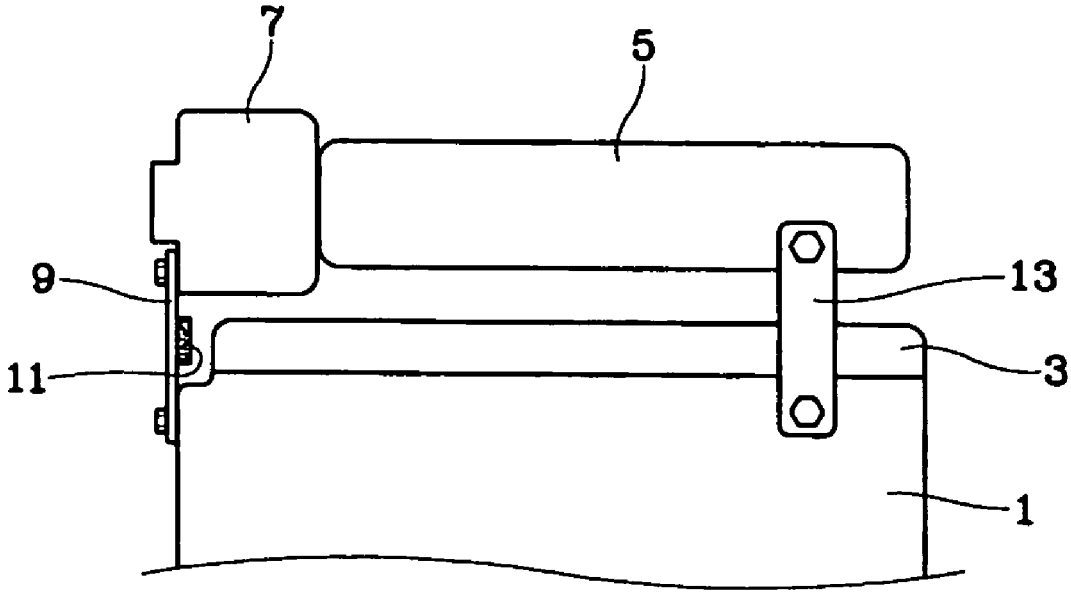
FIG. 1 is a schematic view of a throttle body fixing structure according to an embodiment of the present invention.

Referring to FIGS. 1 to 4, a cylinder head cover 3 is installed on a cylinder head 1 of the engine. A surge tank 5 is installed, spaced from the top surface of the cylinder head cover 3. The surge tank 5 may be made of a plastic material for reducing overall weight.

A throttle body 7 is equipped at the left end of the surge tank 5 as shown in the drawing. When intake air enters into the throttle body 7, the intake air is provided to the engine combustion chamber through the surge tank 5.

A fixing bracket 9 is affixed between the throttle body 7 and the cylinder head 1 of the engine. The bracket 9 preferably extends longitudinally along the direction in which the greatest vibration of the throttle body 7 occurs in relation to the cylinder head 1 while the engine is in operation.

The direction along which the greatest vibration of the throttle body 7 occurs in relation to the cylinder head 1 during the engine operation can be depicted in X, Y, and Z axes. All vibration directions of the throttle body 7 are analyzed without the fixing bracket 9, wherein the throttle body 7 relatively moves in relation to the engine by the exciting force occurred when the engine operates. The direction of the greatest relative vibration of the throttle body 7 in the present invention is most likely in vertical directions from the cylinder head 1 toward the throttle body 7.

Figure 5:
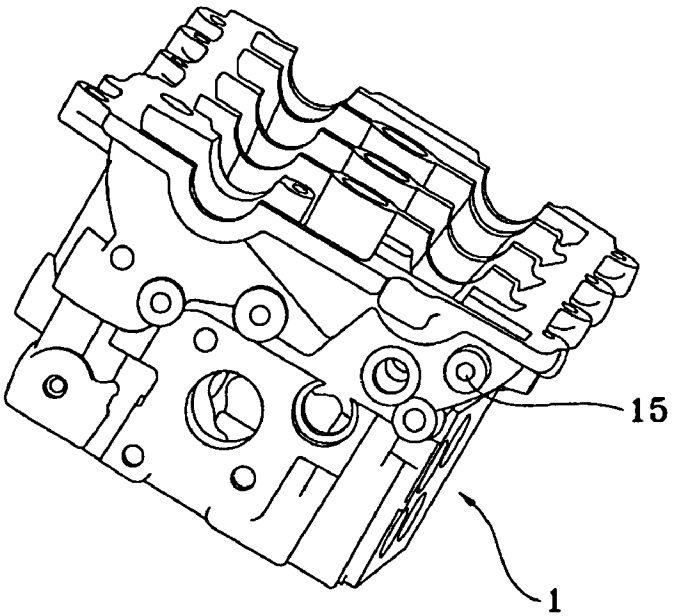
FIG. 5*a* illustrates a cylinder head according to an embodiment of the present invention.
FIG. 5*b* illustrates a throttle body according to an embodiment of the present invention.
Figure 5:
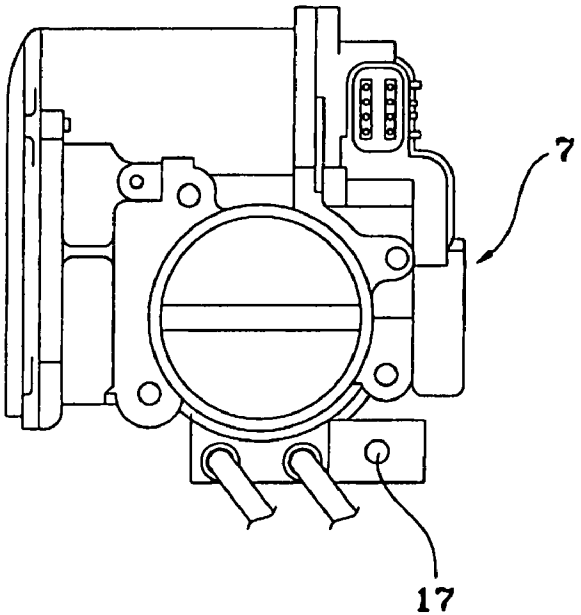
Figure 6:
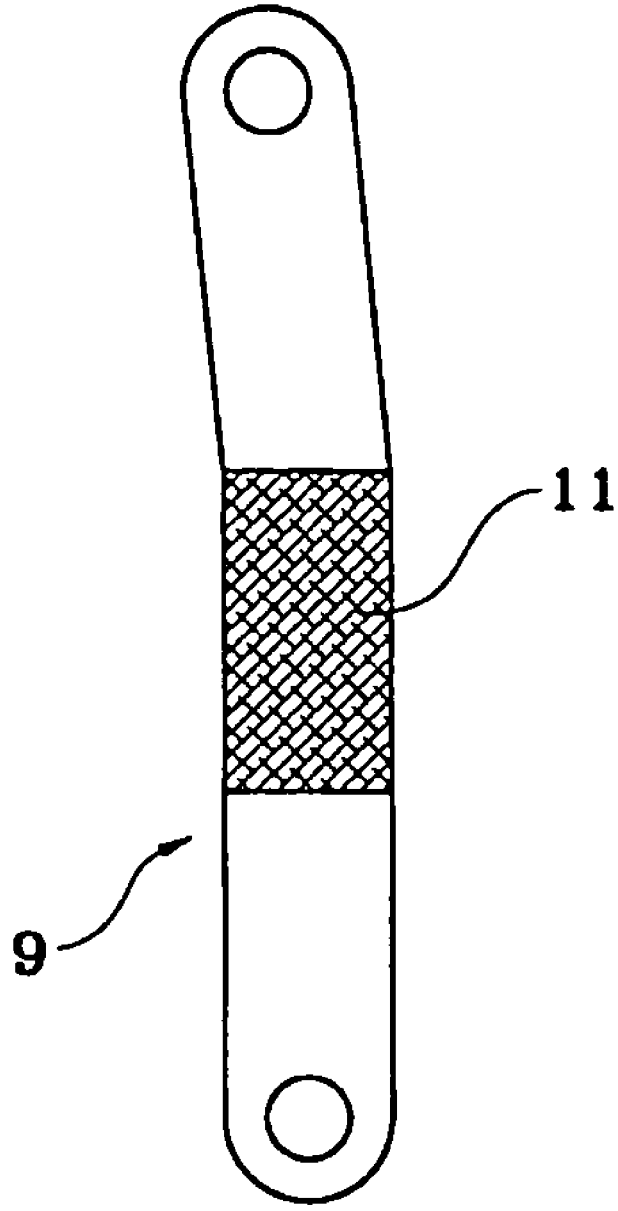
FIG. 6 illustrates a fixing bracket according to an embodiment of the present invention.
Figure 7:
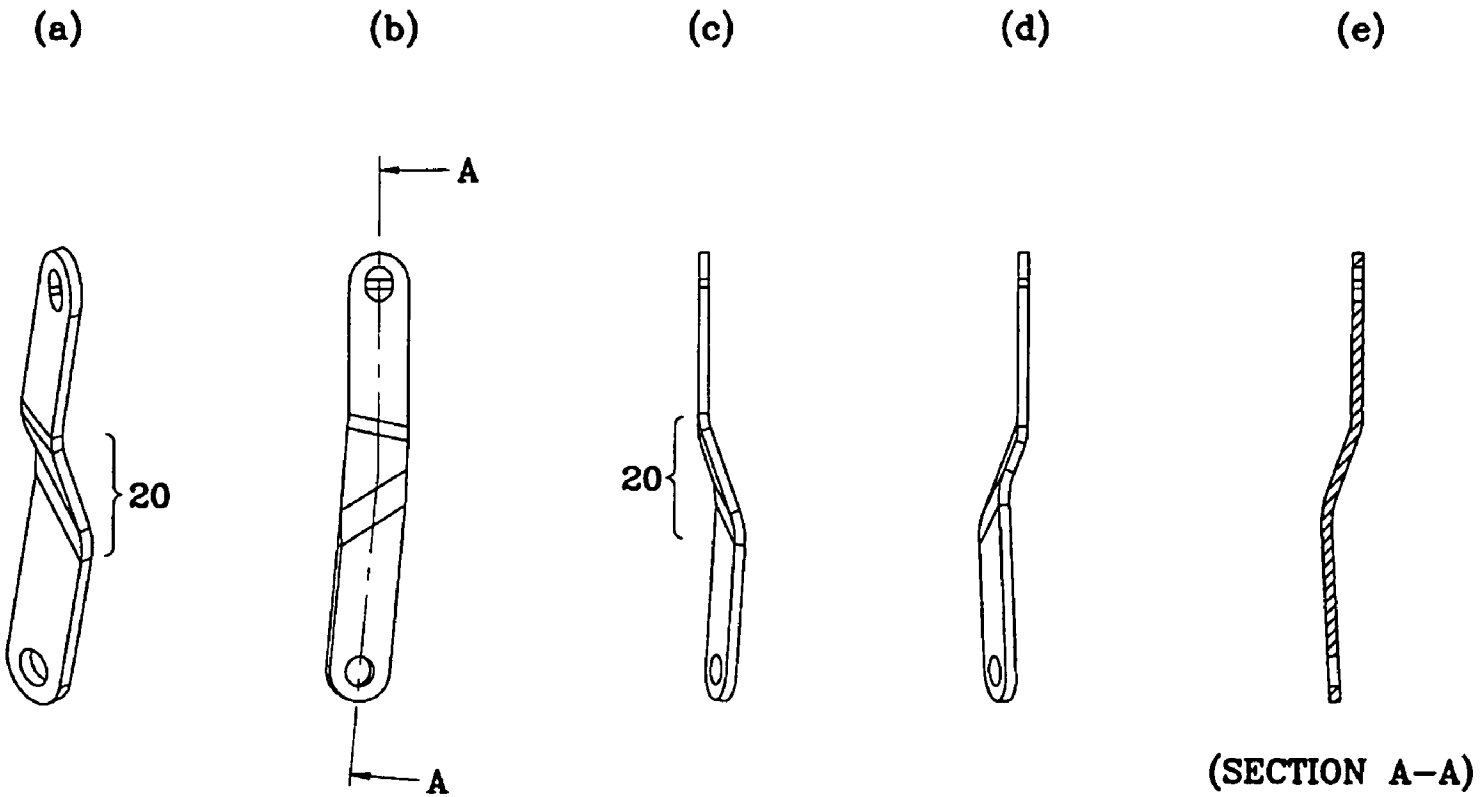
FIG. 7*a* is a perspective view of a fixing bracket according to another embodiment of the present invention.
FIG. 7*b* is a front view of a fixing bracket according to another embodiment of the present invention.
FIG. 7*c* is a left side view of a fixing bracket according to another embodiment of the present invention.
FIG. 7*d* is a right side view of a fixing bracket according to another embodiment of the present invention.
FIG. 7*e* is a sectional view taken along line A—A of FIG. 7*b*.

As illustrated in FIGS. 5*a* and 5*b*, in one embodiment, in order to connect the cylinder head 1 and throttle body 7 by using the fixing bracket 9, the cylinder head 1 is formed with a threaded means 15 and the throttle body 7 is formed with a threaded means 17. The threaded means 15 and 17 are preferably formed in a vertical direction or sloped within the range of ±10°. The fixing bracket 9 of FIGS. 1 to 4 is preferably formed in a vertical direction, however, the threaded means can be positioned within an error allowance of ±10°. For coupling the fixing bracket within the error allowance of ±10°, the upper or lower side of the fixing bracket 9 can slopingly be formed as illustrated in FIG. 6.

A through hole is respectively formed at both ends of the fixing bracket 9. As shown in FIGS. 5*a* and 5*b*, the cylinder head 1 and throttle body 7 are formed with the threaded means 15 and 17, respectively. Both ends of the fixing bracket 9 are fixed to the cylinder head 1 and throttle body 7 via a bolt or the like. One fixing means is coupled to the cylinder head 1 while the other fixing means is coupled to the throttle body 7. Therefore, the throttle body 7 can easily be fixed or released by tightening or loosening only the two fixing means. In FIG. 5*b*, the threaded means 17 is formed at one end of the inlet and outlet of the coolant, i.e., the lower side of the throttle plate of the throttle body 7. The threaded means 17 may be manufactured in a bolt hole shape configuration or the like and may be coupled by a typical fixing means, e.g., a bolt, pin, screw or the like. Alternatively the fixing means may be a threaded stud configuration.

The fixing bracket 9 is formed in a long plain plate shape in a preferred embodiment of the present invention. The middle portion of the fixing bracket 9 may include an acoustic absorption pad 11 distantly placed from the cylinder head cover 3. The throttle body 7 is an electronically controlled throttle body.

With reference to FIG. 1, a supporting bracket 13 is equipped to fix the surge tank 5 to the cylinder head 1. However, the supporting bracket 13 may not be required in other embodiments.

The fixing bracket 9 firmly suppresses excessive vibration of the throttle body 7 in relation to the cylinder head 1. Thus, the vibration and noise of the throttle body 7 and surge tank 5 are effectively decreased in the fixing structure of the engine throttle body 7 of the present invention. That is, Noise Vibration Harshness (NVH) of the throttle body 7 and surge tank 5 can be reduced by merely coupling the fixing bracket 9 via a bolt.

When observing the throttle body 7 and surge tank 5 as one combined assembly, the center of gravity is primarily on the throttle body 7. Furthermore, as the fixing bracket 9 is affixed to the throttle body 7 under the state of highest amplitude of the throttle body vibration being suppressed, the surge tank 5 can properly be fixed. A supplementary supporting bracket 13 may not be required.

The acoustic absorption pad 11 provided at the fixing bracket 9 is applied for preventing the fixing bracket 9 from directly transmitting engine vibration to the throttle body 7. The acoustic absorption pad 11 also absorbs noise and vibration generated from the cylinder head 1 or cylinder head cover 3, thereby minimally affecting the throttle body 7.

Figure 2:
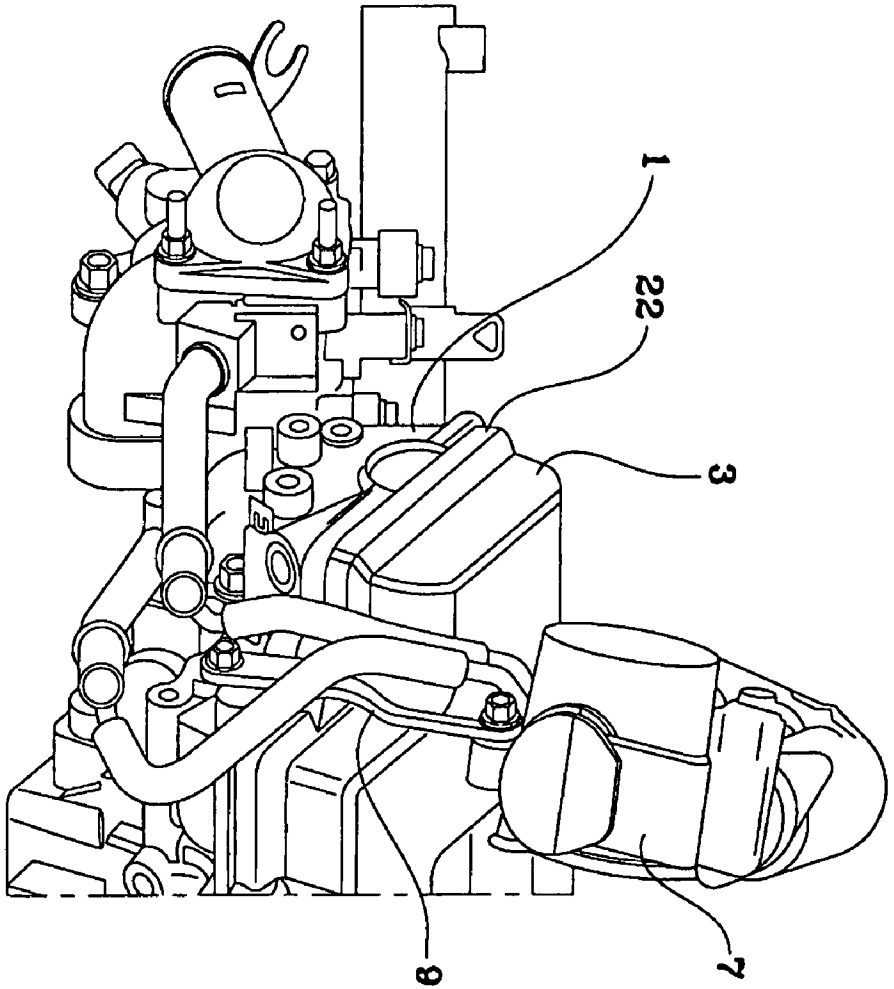
FIG. 2 is a perspective view of a throttle body fixing structure of the present invention.
Figure 3:
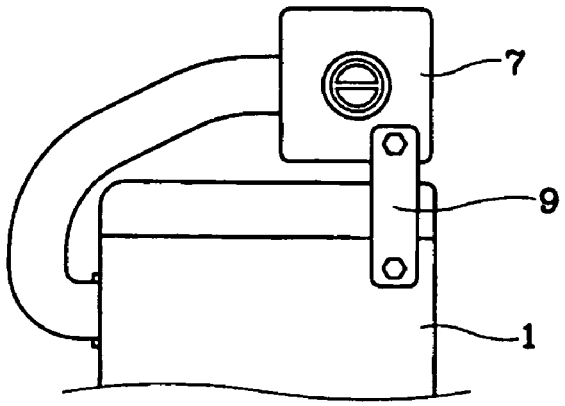
FIG. 3 is a left side view of FIG. 1.
Figure 4:
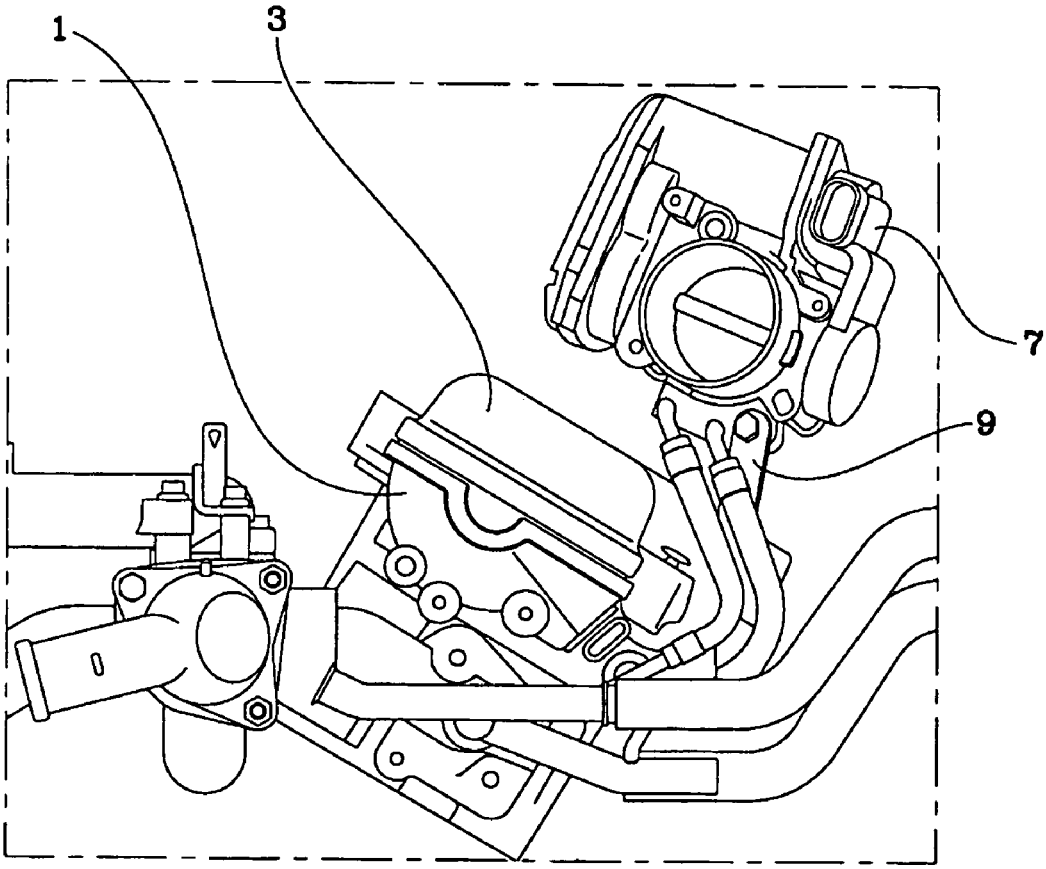
FIG. 4 is a left side view of FIG. 2.

As illustrated in FIGS. 7*a* to 7*e*, the fixing bracket includes an inclined portion 20 such that the upper or lower portion of the fixing bracket 9 relatively protrudes from the other portions of the fixing bracket 9. The inclined portion 20 is formed to prevent interference with a rib 22 of the cylinder head cover 3 when installing the fixing bracket 9 as shown in FIG. 2.

As apparent from the foregoing, there is an advantage in the present invention in that a throttle body connecting to a plastic surge tank can firmly be coupled to the engine under a simple structure, thereby reducing the vehicle weight, and simplifying maintenance and assembly.

There is another advantage in that noise and vibration are minimized and the durability is increased.

What is claimed is:

1. A throttle body fixing structure, comprising:

a throttle body equipped to a surge tank made of a plastic material;

a cylinder head equipped at a top surface thereof with a cylinder head cover; and a fixing bracket connected by a fixing means on said throttle body and a fixing means on said cylinder head, wherein said fixing means on said throttle body is vertically formed at an upper side of said fixing tap of said cylinder head within the range of ±10° from a vertical direction, wherein said fixing bracket is formed in a long plain plate shape, wherein the middle portion of said fixing bracket includes an acoustic absorption pad.

2. The structure as defined in claim 1, wherein said fixing means of said cylinder head and said fixing means of said throttle body are substantially vertically formed.

3. The structure as defined in claim 1, wherein said fixing bracket is formed with an inclined portion.

4. The structure as defined in claim 1, wherein said fixing bracket is longitudinally affixed onto said throttle body and said cylinder head along a direction along which relative vibration between said throttle body and said cylinder head is greatest while the engine is in operation.

5. The structure as defined in claim 1, wherein said fixing means of said throttle body is formed at one side portion of the inlet and outlet of the coolant of said throttle body.

6. The structure as defined in claim 1, wherein said throttle body is an electronically controlled throttle body.

7. The structure as defined in claim 1, wherein a supporting bracket is additionally equipped to fix said surge tank to the engine.

8. The structure as defined in claim 1, wherein both ends of said fixing bracket are secured to said cylinder head and said throttle body, respectively, by fixing means.

9. A throttle body fixing structure for fixing a throttle body to a cylinder head, wherein a cylinder head cover is disposed between said throttle body and cylinder head, and wherein the throttle body has a surge tank mounted thereon, the fixing structure comprising an elongate member configured to extend at least substantially vertically between and be rigidly fixed to said throttle body and said cylinder head with said member spaced from said cylinder head cover.

10. The throttle body fixing structure of claim 9, further comprising vibration dampening means disposed on said elongate member.

11. The throttle body fixing structure of claim 9, wherein said throttle body is metal and the surge tank is plastic.

* * * * *